US005086962A

United States Patent [19]

Costello

[11] Patent Number: 5,086,962

[45] Date of Patent: Feb. 11, 1992

[54] DEVICE FOR BREAKING OPEN PACKAGED ROLLS OF COINS

[76] Inventor: Gerard M. Costello, Haynes Rd., Wilmington, Vt. 05363

[21] Appl. No.: 529,626

[22] Filed: May 29, 1990

[51] Int. Cl.[5] ..... B26F 3/00

[52] U.S. Cl. ..... 225/93; 225/91; 225/103

[58] Field of Search ..... 225/91, 46, 25, 93, 225/103; 30/296.1, 2

[56] References Cited

U.S. PATENT DOCUMENTS

D. 292,139 9/1987 Beal ..... D99/34

1,370,996 3/1921 Pritchard ..... 30/296.1

2,324,349 7/1943 Atkins ..... 225/25

4,665,813 5/1987 Maisonneuve ..... 99/571

4,825,738 5/1989 Jones ..... 83/56

*Primary Examiner*—Frank T. Yost

*Assistant Examiner*—John M. Husar

*Attorney, Agent, or Firm*—Chapin, Neal & Dempsey

[57] ABSTRACT

A device for breaking open cylindrically packaged rolls of coins, has a base and an anvil centrally located on the upper surface of the base. The anvil includes a lower portion affixed to the base and an upper portion against which the roll of coins are struck to break open the same.

5 Claims, 1 Drawing Sheet

DEVICE FOR BREAKING OPEN PACKAGED ROLLS OF COINS

BACKGROUND OF THE INVENTION

The present invention relates to a device for breaking open packaged rolls of coins.

This invention is useful for bank tellers, shop-keepers, cashiers and the like, who cannot afford to waste time making change for customers who almost invariably dislike waiting in lines at banks and check-out counters. Coin rolls are commonly opened by striking against the corner of a cash register or counter top which may be marred or otherwise damaged by this practice and, as hereinafter discussed, Applicant is not aware of any device especially adapted for breaking open coin rolls.

Although unrelated to devices for opening coin rolls, a 1900 Patent to Troxel U.S. Pat. No. 643,698 discloses a knife-edged blade fitted on to the edge of a bucket to be used for breaking or cutting ears of corn for feeding livestock. In 1977, U.S. Pat. No. 4,040,183 was issued to Cassier which does disclose a device for opening coin rolls, however, this opener consists of an L-shaped body 12 having an upright flange 16 of low profile which is constructed to fit between adjacent coins in the coin roll and thereby sever the coin roll wrapper to "open" the same as it is rolled along the narrow flange 16. Among the drawbacks of using this type of opener, are that substantial time and care is required to open the coin roll and also that there is a significant likelihood of cutting one's hand since the flange 16 must be thin enough to fit between adjacent coins.

Accordingly, the principal object of this invention is to provide a device for effectively opening a coin roll in one quick and easy motion and without risk of injury.

The above and other objects and advantages of this invention will be more readily apparent from the following description read in conjunction with the accompanying drawing in which.

Figure 1:
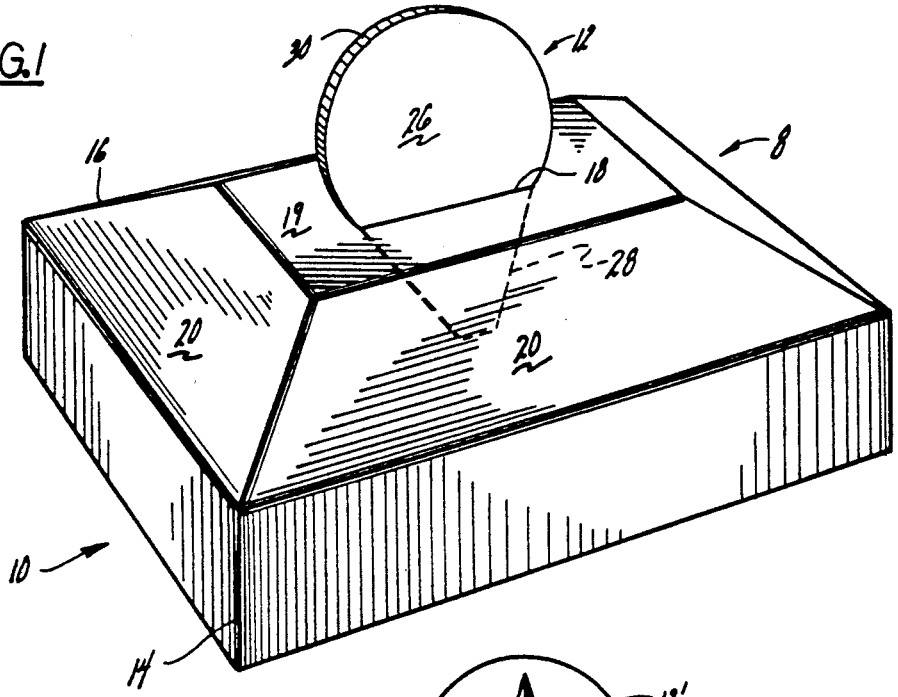
FIG. 1 is a perspective view of the device for opening wrapped rolls of coins of the type embodiment in this invention.

Referring to the drawings, a coin roll opener of the type embodying this invention is shown generally at 8. The coin roll opener 8 comprises a polygonal base 10 and an anvil 12. The base 10 comprises a lower portion 14 and an upper portion 16 which includes a slot 18. The base may be formed of any suitably strong material, such as hardwood, ceramic, metal, or high impact synthetic plastics which can withstand the stresses incident to breaking "open" coin rolls. The plastic may be an opague, translucent or transparent material, such as Lucite or Lexan, as depicted at 10' in FIG. 2. The upper portion 16 is shaped in the form of a truncated pyramid with four faces 20 disposed at oblique angles to the lower portion 14. The faces 20 may be utilized for placing advertising indicia thereon. Top surface 19 is rectangular in shape and includes a centrally located recess or slot 18 shaped to receive, with a secure press-fit, the lower shank portion 28 of the anvil 12 (FIG. 1) or the lower edge portion of anvil 12' (FIG. 2), as will hereinafter be more fully described.

The lower portion 14 of the base 10 is generally rectangular in shape and should be large enough in size and mass for good stability and to both withstand the stresses of opening of coin rolls thereon and to minimize any tendency to move about during use. To cushion the base and to assist in reducing any such tendency, the undersurface of lower portion 14 may be provided with a layer of felt or an elastomeric cushioning and slip-resistant material.

Figure 2:
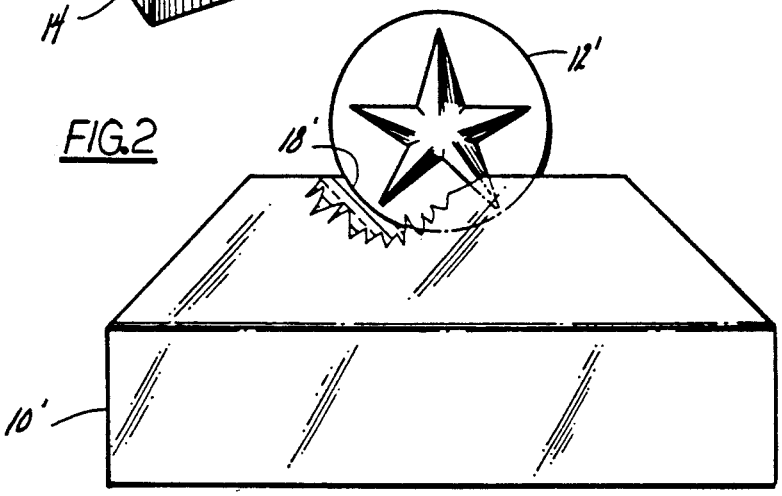
FIG. 2 is a side elevational view, partly in section, of an alternative embodiment of the coin roll opener.

The anvil 12 is utilized for opening the coin roll by striking thereagainst. The anvil 12 is preferably of a tough, strong and durable metallic material and, for appearance, may be a nickle/silver alloy. It may be formed or stamped as one piece of circular configuration, as in FIG. 2, to simulate a coin. The anvil 12 may also comprise a circular head portion 26 and an integral shank portion 28. The anvil or head 26 may also include decorative indicia, as at 30 in FIG. 2, and may be of any suitable shape, such as a convex polygonal or entirely circular shape, as depicted at 12' in FIG. 2. Where the base 10' is made of a transparent material, the anvil 12' will preferably be entirely circular without the shank portion 28, as illustrated in FIG. 1. The opposite surfaces of the anvil may be suitably decorated, as indicated at 30 and the transparent base 10' will permit the entire decorated surfaces to be viewed through the base. In either case, the circular shape is preferred for the upper surface or head portion, so that when a coil roll 40 is struck against the circular edge of the anvil 12 (FIG. 3), the impact will be at one point, or tangential to the roll and will thus concentrate the force of impact to facilitate opening the roll and to reduce the likelihood of injury to the operator's hand. The head has a relatively broad or blunt outer edge 30 which is of sufficient thickness to provide a solid surface for impact of the coin roll 40 thereagainst without fitting between adjacent coins in the roll. Edge 30 of the head 26 may be minted or ribbed, as at ribs 32, to provide a rough, high friction, surface to prevent the coin roll from slipping or glancing off the head 26 when striking the same against the anvil. The head 26 is also of sufficient height or radial dimension above the base 10 such that, when a coin roll is struck thereagainst, the roll will break "open" without the coin roll, itself, or the user's hand striking the base 10 (FIG. 3).

Where the shank 28 is employed, it serves to anchor the anvil 12 to the base 10 and is preferably tapered inwardly and downwardly. The tapered shape is advantageous since it enables the shank 28 to be more easily inserted into slot 18 during assembly to the base 10. To permanently secure the anvil in place, a suitable adhesive or bonding agent may be used. In the case of anvil 12', the adhesive employed is preferably transparent, as is the base 10'.

Figure 3:
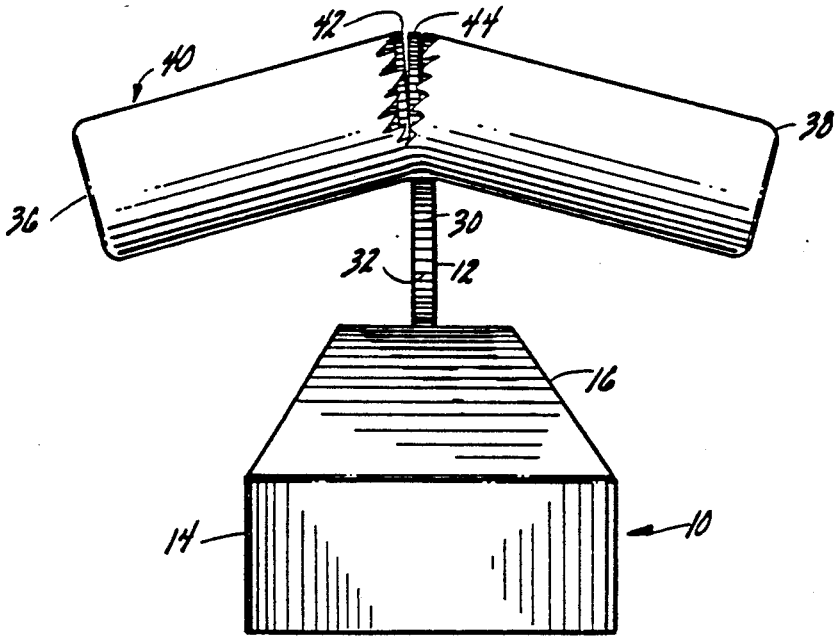
FIG. 3 is an end view of the coin roll opener of FIG. 1 being used to "open" a roll of coins.

As depicted in FIG. 3, the coin roll 40 includes a wrapper 42 and a stack of coins 44. To "open" the wrapper, the underside of the roll is struck against the top edge of anvil 12 whereby inertial forces will result in the outer ends 36 and 38 of the roll 40, deflecting or bending downwardly. Due to this bending stress on the roll 40, the upper central portion of the wrapper 42 will rupture or be torn open in one quick motion and without risk of injury thereby allowing the coins to be easily removed from the wrapper.

Having thus described by invention, what is claimed is:

1. A device for opening rolls of coins packaged in a wrapper comprising a base, an integral anvil extending vertically from side base and having a lower end portion securely anchored into said base, said anvil including an outer edge portion of a generally blunt and convex configuration disposed diametrically opposite the end portion anchored into said base, the outer portion of the convex edge being disposed a sufficient vertical distance above said base and providing equal clearance on both sides of said anvil such that when a coil roll is struck against the outer edge portion of said anvil, in a downward direction, while hand held, the anvil will cause the roll to bend relative to said blunt edge and to rupture the wrapper, without the hand striking the base or anvil, to thereby open the roll of coins.

2. A device for opening rolls of coins, as set forth in claim 1, wherein said anvil has a generally circular shape and said base is a transparent, synthetic plastic material.

3. A device for opening rolls of coins, as set forth in claim 1, wherein said anvil has a ribbed outer edge portion and the undersurface of the base includes an elastomeric material to cushion the base.

4. A device for opening rolls of coins, as set forth in claim 1, wherein said anvil comprises a head portion and a shank portion secured to said base.

5. A device for opening rolls of coins, as set forth in claim 1, wherein said base includes a lower portion of generally rectangular shape and an inwardly tapered upper portion.

* * * * *